US009657704B2

(12) United States Patent
Suzuki et al.

(10) Patent No.: US 9,657,704 B2
(45) Date of Patent: May 23, 2017

(54) ELECTROMAGNETIC RELAY

(71) Applicant: DENSO CORPORATION, Kariya, Aichi-pref. (JP)

(72) Inventors: Yoshiaki Suzuki, Kariya (JP); Mitsuhiro Murata, Niwa-gun (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/513,719

(22) Filed: Oct. 14, 2014

(65) Prior Publication Data

US 2015/0028599 A1 Jan. 29, 2015

Related U.S. Application Data

(63) Continuation of application No. 13/394,237, filed as application No. PCT/JP2011/050111 on Jan. 6, 2011.

(30) Foreign Application Priority Data

Jan. 12, 2010 (JP) ..... 2010-003567

(51) Int. Cl.
*F02N 11/00* (2006.01)
*F02N 11/08* (2006.01)
(Continued)

(52) U.S. Cl.
CPC ..... *F02N 11/087* (2013.01); *F02N 11/08* (2013.01); *F02N 15/067* (2013.01);
(Continued)

(58) Field of Classification Search
USPC ..... 361/206
See application file for complete search history.

(56) References Cited

U.S. PATENT DOCUMENTS 4,791,905 A * 12/1988 Furuta ..... F02D 41/3082 123/494
5,694,100 A 12/1997 Jacquet et al.
(Continued)

FOREIGN PATENT DOCUMENTS

CN 1143159 A 2/1997
CN 101514665 A 8/2009
(Continued)

OTHER PUBLICATIONS

Aug. 7, 2012 International Preliminary Report on Patentability issued in Application No. PCT/JP2011/050111 (with translation).
(Continued)

*Primary Examiner* — Ann Hoang
(74) *Attorney, Agent, or Firm* — Oliff PLC

(57) ABSTRACT

An electromagnetic relay for starting a motor of a starter includes a resistor to reduce an activation current that flows through the motor from a battery for activation of the motor, a relay contact that causes the starting current to flow while bypassing the resistor, a relay coil that forms an electromagnet when excited by energization, and a control circuit that controls an excited state of the relay coil for activation of the motor to open or close the relay contact, thus controlling energization of the motor from the battery via the resistor. The electromagnetic relay incorporates therein the control circuit.

7 Claims, 13 Drawing Sheets

(51) Int. Cl.

| | |
|---|---|
| ***H01H 50/02*** | (2006.01) |
| ***H01H 51/06*** | (2006.01) |
| ***F02N 15/06*** | (2006.01) |
| *F02N 11/10* | (2006.01) |

(52) U.S. Cl.
CPC ..... *H01H 50/021* (2013.01); *H01H 51/065* (2013.01); *F02D 2400/18* (2013.01); *F02N 11/10* (2013.01); *F02N 2011/0881* (2013.01); *F02N 2250/02* (2013.01); *F02N 2250/08* (2013.01)

(56) References Cited

U.S. PATENT DOCUMENTS

| | | | |
|---|---|---|---|
| 5,703,551 | A | 12/1997 | Lefebvre et al. |
| 5,936,497 | A | 8/1999 | Vilou |
| 6,049,263 | A | 4/2000 | Vilou |
| 6,078,491 | A | 6/2000 | Kern et al. |
| 2003/0214766 | A1 | 11/2003 | Hisamoto et al. |
| 2009/0206965 | A1 | 8/2009 | Niimi |
| 2010/0033276 | A1 | 2/2010 | Niimi et al. |
| 2012/0200093 | A1 | 8/2012 | Venkatasubramaniam et al. |

FOREIGN PATENT DOCUMENTS

| | | | | | |
|---|---|---|---|---|---|
| DE | 10 2009 047 635 | A1 | | 2/2011 | |
| EP | 0 751 292 | A1 | | 1/1997 | |
| EP | 0 751 545 | A1 | | 1/1997 | |
| EP | 1 041 277 | A1 | | 10/2000 | |
| EP | 2 080 897 | A2 | | 7/2009 | |
| EP | 2 093 786 | A1 | | 8/2009 | |
| EP | 2 128 426 | A2 | | 12/2009 | |
| EP | 2 151 845 | A2 | | 2/2010 | |
| FR | 2 803 633 | A1 | | 7/2001 | |
| GB | 1338045 | A | * | 11/1973 | ..... H02K 11/25 |
| JP | A-9-105372 | | | 4/1997 | |
| JP | A-10-021810 | | | 1/1998 | |
| JP | A-10-106420 | | | 4/1998 | |
| JP | A-10-154453 | | | 6/1998 | |
| JP | A-2009-032591 | | | 2/2009 | |
| JP | A-2009-068426 | | | 4/2009 | |
| JP | A-2009-224315 | | | 10/2009 | |
| JP | A-2009-287459 | | | 12/2009 | |
| JP | A-2010-040418 | | | 2/2010 | |
| KR | 10-2009-0090284 | | | 8/2009 | |
| WO | WO 2011/064013 | A2 | | 6/2011 | |

OTHER PUBLICATIONS

Mar. 31, 2014 Office Action issued in Chinese Application No. 201180004490.7 (with translation).
Jul. 16, 2013 Extended European Search Report issued in European Application No. 11732837.7.
Jan. 14, 2014 Office Action issued in Japanese Patent Application No. 2013-108136 (with English translation).
Mar. 22, 2011 International Search Report issued in International Application No. PCT/JP2011/050111 (with translation).
Jul. 30, 2013 Office Action issued in Japanese Application No. 2010-003567 (with English translation).
Apr. 15, 2014 Office Action issued in Japanese Patent Application No. 2013-108136 (with English translation).
Feb. 20, 2015 Final Rejection issued in U.S. Appl. No. 13/394,237.
Jun. 25, 2015 Office Action issued in U.S. Appl. No. 13/394,237.

* cited by examiner

ELECTROMAGNETIC RELAY

This is a Continuation application of application Ser. No. 13/394,237 filed Mar. 5, 2012 which is a National Phase of PCT/JP2011/050111 filed Jan. 6, 2011. The disclosure of the prior application is hereby incorporate by reference herein in its entirety.

TECHNICAL FIELD OF THE INVENTION

The present invention relates to an electromagnetic relay provided in a motor circuit of a starter, and particularly, to such an electromagnetic relay integrated with a resistor for reducing an activation current for a motor at engine start-up and designed to bypass the resistor after activation of the motor to energize the motor by the full voltage of a battery.

BACKGROUND ART

Starters for starting engines incorporate therein an electromagnetic switch operative to shift a pinion to a ring gear and to open or close a main contact provided in a motor circuit; the motor circuit is a circuit for allowing current from a battery to a motor.

When the motor is energized, that is, the electromagnetic switch closes the main contact, a high current flows from the battery through the motor as in-rush current. The occurrence of the in-rush current may cause the terminal voltage of the battery to significantly drop, so that a phenomenon, referred to as "short break", in which electric devices, such as meters and audio devices, instantaneously stop working, may occur.

In order to address such a situation, the present applicant has proposed a technology to reduce in-rush current flowing when the motor is energized to prevent the occurrence of "short break" (see a first patent document).

Referring to FIG. 12, an invention disclosed in the first patent document is comprised of, in addition to an electromagnetic switch 101 incorporated in a starter 100, a motor energizing relay (an electromagnetic relay) 102 operative to open or close a motor circuit. Referring to FIG. 13, the relay 102 is comprised of a resistor 105 connected with the motor circuit via two terminal bolts 103 and 104, and a relay contact 106 between an upstream end and a downstream end of the resistor 105; the relay contact 106 consists of a pair of stationary contacts. The relay 102 is operative to open or close the relay contact 106 by a movable contact 108 that can be moved depending on the energized state of a relay coil 107. The energized state of the relay coil 107 is controlled by a drive signal outputted from a control circuit 109 (see FIG. 12). For example, the relay coil 107 is energized to close (turn on) the relay contact 106 when the drive signal of the control circuit 109 is on, and de-energized to open (turn off) the relay contact 106 when the drive signal of the control circuit 109 is off.

When the motor 110 is activated, the drive signal of the control circuit 109 is off, so that the relay contact 106 is opened with the relay coil 107 deenergized. As illustrated in FIG. 12, a current limited by the resistor 105 flows through the motor 110 when the electromagnetic switch 101 closes the main contact 111 in this state. This causes the motor 110 to be turned at a low speed. Thereafter, that is, after engagement of a pinion 112 of the starter 100 with an engine-side ring gear 113, the drive signal is switched from off to on. This results in excitation of the relay coil 107, which closes the relay contact 106. The closed relay contact 106 causes both ends of the resistor 105 to be short-circuited via the relay contact 106. The short-circuit of both ends of the resistor 105 allows the full voltage of a battery 114 to be applied to the motor 110, so that a current higher than that at activation of the motor 110 flows through the motor 110. This increases the rotational speed of the motor 110.

ART DISCUSSED ABOVE

Patent Document

First patent document: Japanese Patent Laid-Open No. 2009-224315

DISCLOSURE OF THE INVENTION

Problems to be Solved by the Invention

As illustrated in FIG. 12, when the control circuit 109 is provided separately from the motor energizing relay 102 at, for example, the vehicle interior or exterior, a dedicated housing for incorporating the control circuit 109 need be prepared. In addition, connection between the control circuit 109 and the battery 114 via power lines and connection between the control circuit 109 and the motor energizing relay 102 via signal lines are needed for transmission of the drive signal to the motor energizing relay 102. This requires the power lines, the signal lines, and wiring for driving the motor energizing relay 102, and becomes a factor that increases points of connection, such as connectors.

If the control circuit 109 is provided at the vehicle exterior, a waterproof frame for incorporating the control circuit 109 is needed in order to protect the control circuit 109 against rainwater or the like.

In view of the above circumstances, an object of one aspect of the present invention is to maintain at a high level the reliability of an electromagnetic relay with a control circuit that controls energization or deenergization of a resistor for preventing "short break".

An object of another aspect of the present invention is to maintain at a high level the environment resistance of an electromagnetic relay with a control circuit that controls energization or deenergization of a resistor for preventing "short break".

Means for Solving the Problems

It is an object of this invention to provide an electromagnetic relay for starting a motor of a starter. The electromagnetic relay includes a resistor to reduce an activation current that flows through the motor from a battery for activation of the motor, a relay contact that causes the starting current to flow while bypassing the resistor, a relay coil that forms an electromagnet when excited by energization, and a control circuit that controls an excited state of the relay coil for activation of the motor to open or close the relay contact, thus controlling energization of the motor from the battery via the resistor. The electromagnetic relay incorporates therein the control circuit.

With the configuration set forth above, incorporation of the control circuit in the electromagnetic relay eliminates a dedicated housing for the control circuit. This results in reduction in points of connection, such as connectors, for wiring, and in simplification of wiring around the electromagnetic relay, making it possible to improve its reliability.

Moreover, because the control circuit is incorporated in the electromagnetic relay, it is possible to eliminate the need to secure a space for installation of the control circuit separated from the electromagnetic relay, thus improving its installability.

Some embodiments further include: a case having a bottom portion at one end thereof in an axial direction of the relay coil, and an opening portion that opens at the other end in the axial direction, the relay coil being accommodated in the case; a movable core movable, inside of the relay coil, in the axial direction of the relay coil; a fixed core arranged in the axial direction of the relay coil to be opposite to the movable core; a first partitioning wall member; a second partitioning wall member, the first and second partitioning wall members being arranged at the respective one and the other ends of the relay coil in the axial direction thereof, each of the first and second partitioning wall members forming a part of a magnetic circuit; a resin cover fixed to the case while closing the opening portion of the case; a first stationary contact located in a contact chamber that is an inner space of the cover, the contact chamber being formed at an anti-coil side relative to the second partitioning wall member, the first stationary contact being connected with the battery via a first external connection terminal fixed to the cover; a second stationary contact located in the contact chamber and connected with the motor via a second external connection terminal fixed to the cover; and a movable contact movable in an axial direction in the contact chamber with motion of the movable core. The resistor is electrically connected between the first external connection terminal and the second external connection terminal in the contact chamber, and the relay contact is closed when the movable contact abuts onto the first and second stationary contacts so that both the first and second stationary contacts are electrically conducted via the movable contact, and is opened when the movable contact is separated from the first and second stationary contacts.

With the configuration set forth above, the control circuit is accommodated in the housing of the electromagnetic relay. This facilitates electrical connections between the control circuit and the relay coil. If the control circuit were installed separately from the electromagnetic relay, such as arranged outside of the electromagnetic relay, electrical wires connecting between the control circuit and the relay coil would be exposed externally. This would need caution during routing of electrical wiring, and there could be a break in a wire due to external vibrations, such as engine vibrations.

In contrast, according to some embodiments, electrical connections between the control circuit and the relay coil are completed within the housing of the electromagnetic relay. This eliminates the need to externally route electrical wiring connecting the control circuit and the relay coil, and there are no possibilities of breaks of wires due to vibrations. In addition, because the control circuit is stored in the housing of the electromagnetic relay, it is possible to ensure that the housing of the electromagnetic relay is waterproof, thus improving its reliability and environment resistance.

Preferably, the control circuit is comprised of an IC.

Because an IC (Integrated circuit) is used as the control circuit, it is possible to improve its heat resistance in comparison to, for example, a plated circuit on which a plurality of circuit elements are mounted. This makes it possible to use the electromagnetic relay under harsher conditions in ambient temperatures and vibrations.

Moreover, using an IC allows the control circuit to be compacted. This makes it possible to easily install the IC in a limited space of the electromagnetic relay, thus reducing in size the electromagnetic relay integrating therein the control circuit.

Alternatively, the IC includes a package that protects a circuit element, and the package is attached in intimate contact with any one of the first and second partitioning wall members, each of the first and second partitioning wall members being made of a metal member.

Any one of the first and second partitioning wall members is a magnetic material forming a part of the magnetic circuit, and therefore is, for example, made of metallic construction, such as iron. For this reason, attaching the package of the IC to any one of the first and second partitioning wall members, which is a metal member, to intimate contact therewith allows heat due to loss of the circuit to be transferred to any one of the first and second partitioning wall members. This improves the lifetime of the circuit and increases energized time.

Preferably, the relay coil includes: a coil body; and a resin bobbin serving as a frame around which the coil body is wound. The IC is molded, together with any one of the first and second partitioning wall members to which the package is closer adjacent, in a resin member, the resin member being formed integrally with the resin bobbin.

With the configuration set forth above, molding the IC in the resin member allows the IC to be reliably fixed, and prevents abrasion powders of the relay contact and the like from depositing between IC terminals, thus preventing reduction in the insulating properties between the IC terminals.

In some embodiments, the electromagnetic relay includes an external terminal externally taken out from the cover; and a signal transfer terminal that transfers a signal inputted via the external terminal to the IC, the signal transfer terminal being secondarily molded inside a cylindrical body of the bobbin, the cylindrical body supporting an inner diameter of the relay coil. The IC is molded, together with the first partitioning wall member, in the resin member with the package intimate contacting with the first partitioning wall member, and connected with the external terminal via the signal transfer terminal, the resin member being formed integrally with the bobbin.

If the IC is arranged the bottom portion of the bottomed case, that is, the IC is molded in the resin member together with the first partitioning wall member, there is a need to connect, after a wire is wound around the bobbin, a coated lead wire or the like, which is connected with the IC, with an external terminal while passing in the radial outside of the relay coil. In this case, there is a need to secure a space to pass the coated lead wire or the like in the radial outside of the relay coil. This results in an increase of the electromagnetic relay in radial dimension, thus an increase of the electromagnetic relay in size.

In contrast, in some embodiments, the electromagnetic relay passes the signal transfer terminal through the inside of the cylindrical body of the bobbin to allow the IC and the external terminal to be connected with each other via the signal transfer terminal. This configuration eliminates the need to secure a space in the radial outside of the relay coil, making it possible to reduce the electromagnetic relay in size. Note that the external terminal and the signal transfer terminal can be separated from each other, or can be integrally provided.

Preferably, the control circuit includes at least one of: an activation-current reduction preventing function of closing, at startup of an engine, the relay contact to energize the motor based on a full voltage of the battery without energizing the motor via the resistor; a temperature protection function of shutting down power to be supplied to the control circuit when detecting an abnormal temperature exceeding a preset allowable temperature; an overcurrent protection function of shutting down power to be supplied to the control circuit when detecting an overcurrent exceeding a preset allowable current flows; and a resistive-element energized-duration adjusting function of adjusting an energized duration of the resistor at energization of the motor via the resistor at startup of the engine.

For example, in an idle reduction vehicle for automatically controlling engine stop and restart, the activation-current reduction preventing function prevents reduction in an activation current for the motor during idle reduction being disabled in the system, in other words, during a cold period in which the engine is difficult to crank. That is, the function does not energize the motor via the resistor at engine startup, but energizes the motor based on the full voltage of the battery. This makes it possible to improve the start-up performance of the engine even during a cold period in which the engine is difficult to crank.

The temperature protection function shuts down power to be supplied to the control circuit when detecting an abnormal temperature exceeding a preset allowable temperature. This prevents occurrence of circuit failure.

The overcurrent protection function shuts down power to be supplied to the control circuit when an overcurrent, which exceeds a preset allowable current, flows. This prevents induction of circuit failure.

The resistor energized-duration adjusting function works to adjust an energized duration of the resistor in energization of the motor via the resistor at activation of the motor. For example, when the starter 1 is a high-temperature state, this function increases the energized duration of the resistor, that is, the duration of the relay contact being opened. As a result, it is possible to improve the start-up performance of the engine, and supply, in a balanced manner, a starter current so as to reduce voltage drop across the battery generated by the starter current.

Preferably, the electromagnetic relay has a normally-closed contact structure in which the movable contact abuts onto the first and second stationary contacts with the relay coil deenergized so that the relay contact is closed, and the control circuit includes at least the temperature protection function, and is disposed in the contact chamber.

If the control circuit is disposed in the contact chamber as well as the resistor, the control circuit is subjected to radiation heat emitted from the resistor when the resistor is energized. Thus, the temperature protection function works to shut down the supply of power to the control circuit when the control circuit detects an abnormal temperature due to heat being produced from the resistor caused by abnormal continuous energization of the resistor. Note that the control circuit is disposed with a suitable distance from the resistor for prevention of failure of the control circuit due to heat of the resistor before activation of the temperature protection function. In other words, the control circuit is located in an area that allows the temperature protection function to be effectively performed upon heat being produced from the resistor.

This deactivates the control circuit to interrupt a drive signal to the relay coil; the interruption closes the relay contact to form an energization path bypassing the resistor. This results in limitation of current flowing through the resistor, thus reducing production of heat from the resistor. This prevents the resistor from being melted due to such abnormal heat of the resistor.

Thereafter, when the system returns to normal, there is no need to replace the resistor so that the resistor is continuously used because the resistor is not melted. In addition, when the system returns to normal, the electromagnetic relay operates normally because there is nothing wrong with the control circuit.

Preferably, the control circuit is electrically connected with a power line that supplies power from the battery to the relay coil, and is disposed electrically upstream of the relay coil.

The electromagnetic relay according to this invention whose bottomed case is connected with ground operates only when the control circuit is interposed between a power input terminal and the relay coil without widely changing the power input terminal, a signal input terminal for the relay coil, and a signal route of a ground terminal of the relay coil. For this reason, it is possible to easily use the control circuit according to the invention for similar electromagnetic relays.

Preferably, the control circuit is electrically connected with a power line that supplies power from the battery to the relay coil, and is disposed electrically downstream of the relay coil.

According to this invention, connecting the control circuit with the downstream of the relay coil allows a current flowing out of the relay coil to flow from a ground terminal of the control circuit to ground. That is, the ground terminal of the control circuit and a ground terminal of the relay coil can be shared with each other. This reduces the number of terminals.

Preferably, the electromagnetic relay includes a common line shared as a power line for supplying power to the control circuit, a power line for supplying power to the relay coil, and a signal line for transmitting a trigger signal to activate the control circuit. The common line is connected with an energization line for energizing, via a starter relay, an excitation coil of an electromagnetic switch for a starter based on the battery, the common line receiving a supply of power for the control circuit and the relay coil, and capturing the trigger signal.

According to the configuration set forth above, because the power lines and the signal lines are shared, it is possible to eliminate lines only for power supply. This reduces the number of terminals to thereby simplify the electromagnetic relay.

Thus, the electromagnetic relay according to this invention can operate by only supplying a branch signal from the energization line 45 of the electromagnetic switch 5 thereto without widely changing the existing wiring.

Preferably, the control circuit comprises a MOSFET that controls an excited state of the relay coil; and a surge absorbing element that absorbs a surge, the surge being generated when the starter relay is opened.

With the configuration set forth above, the serve absorbing element integrated in the control circuit is capable of absorbing a surge generated when the relay coil is deenergized, in other words, the starter relay is opened. In addition, a surge, which flows from the excitation coil of an electromagnetic switch for starters to pass through the energization line into the control circuit, is absorbed by an intrinsic diode formed in the MOSFET integrated in the control circuit. This reduces an arc caused from the contacts of the starter relay due to a surge generated in the excitation coil of the electromagnetic switch for starters when power supply is stopped, thus improving the lifetime of the starter relay.

EMBODIMENTS FOR CARRYING OUT THE INVENTION

Embodiments of the present invention will be described hereinafter with reference to the drawings.

First Embodiment

The first embodiment is configured such that an electromagnetic relay according to the present invention is attached to a motor circuit of a starter 1 (see FIG. 3) for starting, for example, an internal combustion engine (engine) for motor vehicles. The electromagnetic relay according to the first embodiment will be referred to as a motor energizing relay 2 hereinafter.

Figure 3:
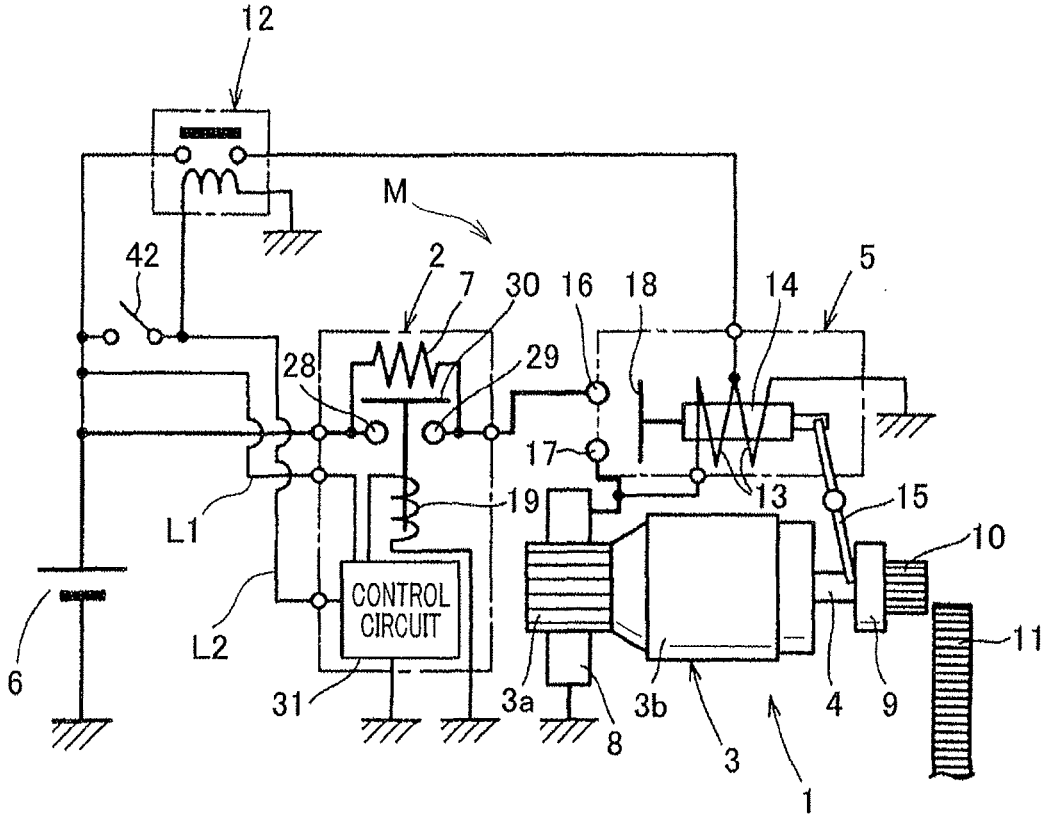
FIG. 3 is an electrical circuit diagram of a starter according to the first embodiment.

Referring to FIG. 3, the starter 1 is comprised of a motor 3 for generating torque, an output shaft 4 driven by the motor 3 to rotate, and a pinion movable member, described later, provided on the outer circumference of the output shaft 4 to be movable in the axial direction of the output shaft 4. The starter 4 is also comprised of an electromagnetic switch 5, a shift lever 15, the motor energizing relay 2, and so on. The electromagnetic switch 5 is operative to shift the pinion movable member in a direction opposite to the motor (the right direction in FIG. 3) and to open or close a main contact, described later, provided in a motor circuit described later. The motor energizing relay 2 is integrated with a resistor 7 for reducing an activation current to flow from a battery 6 to the motor 3. Note that a reduction unit, such as a planetary gear reduction unit, for reducing rotation of the motor 3 to amplify torque can be provided between the motor 3 and the output shaft 4.

FIG. 3 illustrates a control system for driving and controlling the starter 1. The control system is comprised of the battery 6, a starting switch 42, a motor circuit M for energizing the motor, and a starter relay 12 for driving the pinion movable member; the motor circuit M includes the motor energizing relay 2, referred to as a relay 2 hereinafter.

The motor 3 is a well-known commutator motor consisting of a field (not shown) constructed by permanent magnets or electromagnets (not shown), an armature 3*b* having a commutator 3*a*, brushes 8 mounted on the outer circumference of the commutator 3*a*, and so on. Specifically, the motor 3 is adapted to rotate the output shaft 4 based on relative actions of a magnetic field generated by the armature 3*b* energized via the brushes 8 and the commutator 3*a* and a magnetic field generated by the field.

The pinion movable member consists of a clutch 9 and a pinion 10.

The clutch 9 consists of an outer mounted on the outer circumference of the output shaft 4 in helical spline engagement with each other, an inner provided together with the pinion 10, a roller for intermitting the transfer of rotational force between the outer and the inner, and so on. The clutch 9 is designed as a one-way clutch that transfers, via the roller, rotational force in only one direction from the outer side (output shaft 4) to the inner side (pinion 10).

For starting the engine, the pinion 10 is shifted by operations of an actuator described later in the anti-motor direction (a direction away from the motor 3) on the outer circumference of the output shaft 4 to be engaged with a ring gear 11 of the engine. When the motor 3 is driven, rotational force of the motor 3 is transferred to the ring gear 11 via rotation of the pinion 10, so that the ring gear 11 is rotated. The rotation of the ring gear 11 cranks the engine.

The electromagnetic switch 5 consists of an excitation coil 13 and a plunger 14. The excitation coil 13 is connected with the battery 6 via the starter relay 12. The plunger 14 is provided inside the excitation coil 13 to be movable in the axial direction of the excitation coil 13.

A shift lever 15 has one end and the other end in its length direction. The one end of the shift lever 15 is swingably attached to one end of the plunger 14, and the other end of the shift lever 15 is swingably attached to the pinion movable member.

The electromagnetic switch 5 is operative to move the plunger 14 in the axial direction by attractive force of an electromagnet formed by the excited excitation coil 13, thus opening or closing the main contact with the shift of the plunger 14, and to shift the pinion movable member in the anti-motor direction via the shift lever 15. Note that the electromagnetic switch 5 and the shift lever 15 constitute an actuator for driving the pinion movable member set forth above.

The main contact in the motor circuit M consists of, for example, a pair of stationary contacts 16 and a movable contact 18. The stationary contacts 16 and 17 are arranged to be opposite to the other end of the plunger 14, and coupled to the battery side and the motor side via two terminal bolts (not shown), respectively. The movable contact 18 is attached to, for example, the other end of the plunger 14 and configured to be movable with motion of the plunger 14 in the axial direction of the plunger 14. Specifically, the movable contact 18 can move to abut on the stationary contacts 16 and 17 or to be separated therefrom depending on the axial motion of the plunger 14.

That is, when the movable contact 18 abuts on the pair of the stationary contacts 16 and 17 by the drive of the plunger 14, both the stationary contacts 16 and 17 are electrically conducted, so that the motor circuit M is closed (turned on). When the movable contact 18 is separated from the pair of the stationary contacts 16 and 17, the motor circuit M is opened (turned off). Note that one of the two terminal bolts connected with the high potential side (battery side) of the motor circuit M will be referred to as a B terminal bolt, and the other thereof connected with the low potential side (motor side) of the motor circuit M will be referred to as an M terminal bolt.

Next, the structure of the motor energizing relay 2, referred to as a relay 2, will be described in detail based on FIG. 1.

The relay 2 is comprised of the resistor 7, a relay contact (described later), and a relay coil 19 that forms an electromagnet when excited by energization; the relay contact can connect between the battery 6 and the motor 3 while bypassing the resistor 7. The relay 2 is operative to open or close the relay contact depending on the excited state of the relay coil 19.

Specifically, the relay 2 is comprised of a relay case 20, a resin bobbin 33, the aforementioned relay coil (coil body) 19, and a magnetic plate 21. The relay case 20 serves as a magnetic circuit (yoke). The relay coil 19 is accommodated in the relay case 20. The magnetic plate 21 is made of metallic construction, such as iron, and disposed to be adjacent to one end (the left side in FIG. 1) of the relay coil 19. The relay 2 is also comprised of a movable core 22, a partition wall member 23, and a fixed core 24. The movable core 22 is provided inside the relay coil 19 to be movable in the axial direction of the relay coil 19. The partition wall member 23 is arranged to be adjacent to the other end of the relay coil 19. The fixed core 24 is arranged to be opposite to the movable core 22 in its axial direction.

Moreover, the relay 2 is comprised of a resin contact cover 25, first and second external connection terminals 26 and 27, and first and second stationary contacts 28 and 29. The contact cover 25 is fixed to the relay case 20 while closing an opening portion of the relay case 20 described later. The first and second external connection terminals 26 and 27 are fixed to the contact cover 25. The first and second stationary contacts 28 and 29 are connected with the battery 6 and the stationary contact 16 via the first and second external connection terminals 26 and 27, respectively. In addition, the relay 2 is comprised of a movable contact 30, the resistor 7, a control circuit 31, a contact pressure spring 40, and so on. The movable contact 30 electrically intermits a path between the first and second stationary contacts 28 and 29. The resistor 7 is electrically connected between the first and second external connection terminals 26 and 27. The control circuit 31 is operative to control the excited state of the relay coil 19.

The relay case 20 has a substantially cylindrical shape. The relay case 20 has a flat bottom portion 20*a* at one end (the left side in FIG. 1) in its center direction, and an opening portion at the other end in its center axis direction. Note that, as described above, in the relay 2 illustrated in FIG. 1, the left side of the relay case 20 in its center axis direction will be referred to as "one end side", and the right side of the relay case 20 in its center axis direction will be referred to as "the other end side".

The relay case 20 is manufactured by, for example, a drawing process. The relay case 20 is constructed such that the inner diameter of the one end side (the bottom-portion 20*a* side) in its axial direction is slightly longer than that of the other end side (the opening-portion side); the relay coil 19 is to be contained in the one end side of the relay case 20. The relay case 20 is formed with a stepped portion (a stepped shoulder) at the boundary between the inner circumference of the one end side and that of the other end side.

A metal bracket 32 is mechanically joined on the outer side surface of the bottom portion 20*a* of the relay case 20 by, for example, welding. Via the bracket 32, the motor energizing relay 2 is fixed to a housing (not shown) of the starter 1.

The bobbin 33 has an inner hollow cylindrical body, and has first and second flanges at both ends of its axial direction. The bobbin 33 is coaxially contained in the relay case 20 with its first flange located in contact onto or close to the magnetic plate 21.

The relay coil 19 is comprised of a wire wound around the bobbin 33. Referring to FIG. 3, the relay coil 19 has one end as a high-potential side connected with the control circuit 31, and the other end as a low-potential side connected with ground via the relay case 20 serving as a magnetic member.

The magnetic plate 21 constitutes, for example, a first partition wall member. The magnetic plate 21 is formed into a substantially annular shape with a thickness substantially identical to the thickness of the relay case 20, and with a round hole (a cylindrical opening) at its radial center. The magnetic plate 21 constitutes a radial magnetic path (a part of a magnetic circuit) between the relay case 20 and the movable core 22. The round hole opens with an inner diameter being slightly larger than the outer diameter of the movable core 22; this clearance allows the movable core 22 to axially move inside the round hole. For example, the inner diameter of the cylindrical opening of the magnetic plate 21 is substantially in agreement with the diameter of the inner periphery of the bobbin 33 with the cylindrical opening of the magnetic plate 21 communicating with the inner peripheral opening of the bobbin 33 in their axial directions.

The movable core 22 has, for example, a substantially cylindrical shape, and is provided in the opening of the magnetic plate 21 and in the inner peripheral opening of the bobbin 33 to be movable in the axial direction of the bobbin 33. The movable core 22 has an H shape (the cross-sectional shape in FIG. 1) in its axial cross section passing through the radial center thereof, providing cylindrical concave portions (grooves) at both ends of its axial direction. One end of the movable core 22 opposite to the bottom portion 20*a* projects toward the bottom portion 20*a* relative to the magnetic plate 21.

A spacer member 34 made of, for example, a non-magnetic member, such as resin and rubber, is arranged between the movable core 22 and the magnetic plate 21. Note that the spacer member 34 can be arranged only between the bottom portion 20*a* of the relay case 20 and the movable core 22. That is, no spacer member 34 can be arranged between the bottom 20*a* of the relay case 20 and the magnetic plate 21, so that a clearance (a space) can be provided therebetween. Alternatively, the magnetic plate 21 increased in thickness can abut on the bottom portion 20*a* of the relay case 20 as long as the movable core 22 can move correctly.

The partitioning wall member 23 made of, for example, iron constitutes, for example, a second partition wall member. The partitioning wall member 23 is formed into a substantially annular shape with a thickness larger than the thickness of the relay case 20, and with a cylindrical opening at its radial center. The partitioning wall member 23 has an outer periphery. A coil-side end of the outer periphery (the left-side end of the outer periphery in FIG. 1) of the partitioning member 23 in its thickness direction abuts on the shoulder formed at the inner circumference of the relay case 20 with the second flange of the bobbin 33 being joined to the coil-side end surface of the partitioning wall member 23. Specifically, the partitioning wall member 23 regulates the positions of the coil 21 and its peripheral members of the relay 2. The partitioning wall member 23 also forms a magnetic path (a part of a magnetic circuit) extending radially from the inner circumference of the relay case 20.

The fixed core 24 is provided to be integrated continuously with the inner periphery of the partitioning wall 23 while projecting in its axial direction from the partitioning wall 23 toward the movable core 22 to enter the inner peripheral opening of the relay coil 19 (bobbin 33), so that it is arranged to be opposite to the movable core 22 in the axial direction of the movable core 22. For example, the inner diameter of each of the cylindrical openings of the partitioning wall member 23 and the fixed core 24 is substantially identical to the inner diameter of the cylindrical concave portion of the movable core 22, so that the cylindrical opening of the fixed core 24 faces the cylindrical concave portion of the movable core 22 in their axial directions. Note that the partitioning wall member 23 and the fixed core 24 need not be integrally provided. They can be provided separately and mechanically and electrically joined to each other to form a continuous magnetic path.

The partitioning wall member 23 and the fixed core 24 are collectively referred to as a magnetic-circuit component. The magnetic-circuit component is molded (insert molded) together with the control circuit 31 in a resin member 33*a* integrally formed with the bobbin 33, so that the magnetic-circuit component is integrated with the bobbin 33.

The cylindrical openings of the partitioning wall member 23 and the fixed core 24 of the magnetic-circuit component constitute a through hole for receiving therethrough a shaft 35 described later.

The contact cover 25 has a substantially hollow cylindrical shape, a tubular leg portion 25*a* at one end of its axial direction, and a bottom at the other end of its axial direction. One end of the leg portion 25*a* is inserted in the opening portion of the relay case 20 so as to be assembled to the relay case 20 while being in contact with the outer periphery of the anti-coil-side (right-side) end surface of the partitioning wall 23. Crimping the opening end of the relay case 20 over a circumferential part or the entire circumference of the leg portion 25*a* fixes the contact cover 25 in the relay case 20.

A seal member 36, such as an O-ring, seals between the contact cover 25 and the relay case 20, preventing external entry of water or the like.

The first external connection terminal 26 is connected with the positive terminal of the battery 6 via a cable. The second external connection terminal 27 is, for example, connected with the B terminal bolt of the electromagnetic switch 5 via a metal connection member, a cable, or the like. Referring to FIG. 1, each of the first and second external connection terminals 26 and 27 has a bolt shape; the head of each bolt is disposed inside the contact cover 25, and the threaded portion thereof projects outside the contact cover 25 while passing through a through hole formed through the bottom of the cover 25 so as to be fixed to the contact cover 25 with washers 37 and 38.

The relay contact is made up of the first and second stationary contacts 28 and 29. Abutment of the movable contact 30 onto the first and second stationary contacts 28 and 29 causes both the stationary contacts 28 and 29 to be electrically conducted via the movable contact 30, closing (turning on) the relay 2. Separation of the movable contact 30 from the first and second stationary contacts 28 and 29 opens (turns off) the relay 2.

The first stationary contact 28 is located in the inner space, referred to as a contact chamber 39, of the contact cover 25, electrically connected with the second external connection terminal 27, and mechanically fixed; the contact chamber 29 is formed at an anti-coil side relative to the partitioning wall 23.

Like the first stationary contact 28, the second stationary contact 29 is located in the contact chamber 39, electrically connected with the second external connection terminal 27, and mechanically fixed.

Note that the first and second stationary contacts 28 and 29 can be integrated with, for example, the bolt heads of the respective first and second external connection terminals 26 and 27.

The movable contact 30 is located to be closer to the other end side in the axial direction than the first and second stationary contacts 28 and 29. The movable contact 30 is subjected to the load of the contact pressure spring 40 with the relay coil 19 de-energized, so that it is pressed to be in contact with the first and second stationary contacts 28 and 29 (that is, the relay 2 is closed, as illustrated in FIG. 1). When the relay coil 19 is energized, motion of the movable core 22 attracted to abut onto the fixed core 24 is transferred to the movable contact 30 via the shaft 35. Then, the movable contact 30 moves toward the other end side (the right side in FIG. 1) in the axial direction while compressing the contact pressure spring 40 so as to be separated from the first and second stationary contacts 28 and 29 (that is, the relay 2 is opened).

Figure 1:
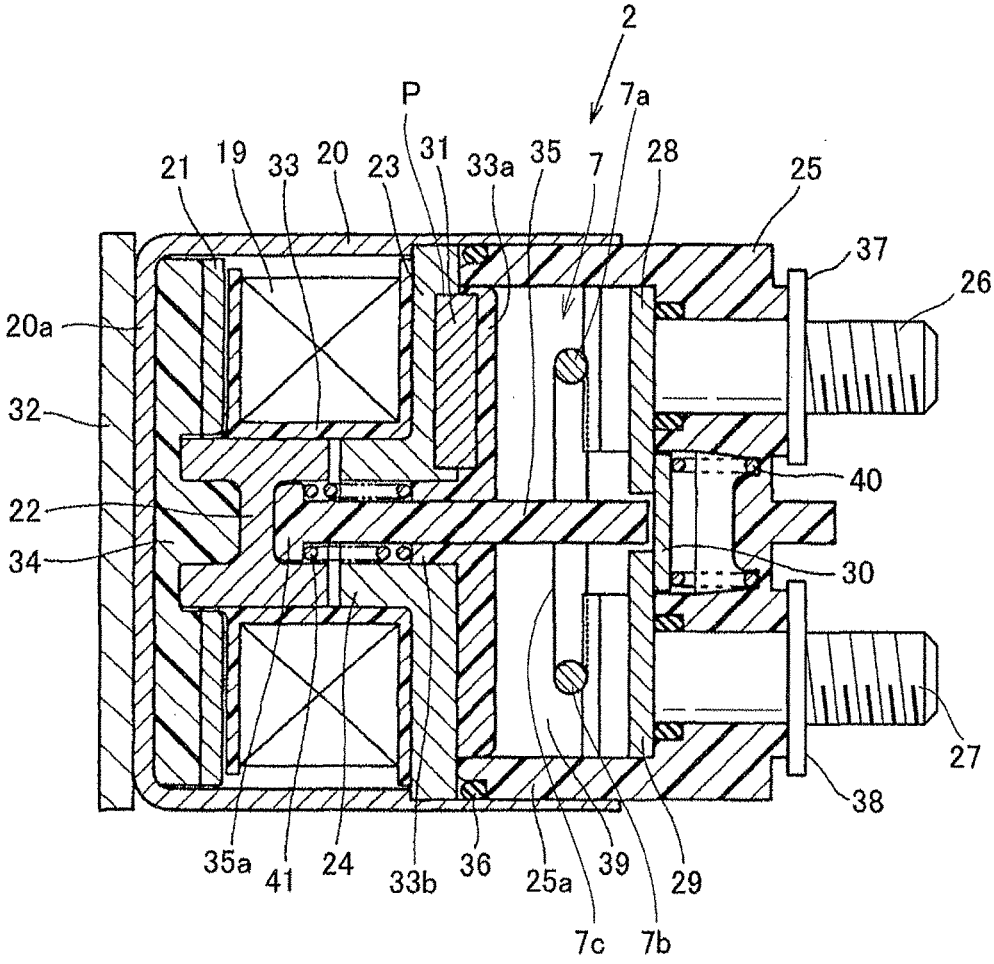
FIG. 1 is a cross sectional view of a motor energizing relay according to the first embodiment of the present invention.

Specifically, as illustrated in FIG. 1, the motor energizing relay 2 according to this embodiment has a normally-closed contact structure in which the relay contact is closed with the relay coil 19 de-energized.

The resin member 33*a* is formed to have a ring with a cylindrical opening at its radial center. A guide member 33*b* is integrally formed to be continuous with the inner surface of the resin member 33*a*. The guide member 33*b* projects in its axial direction from the resin member 33*a* toward the movable core 22 so as to be fit in the through hole formed in the magnetic-circuit component.

The shaft 35 is provided to be separated from the movable core 22, and made of a resin member. The shaft 35 is threaded through the cylindrical opening of the guide member 33*b* in the axial direction.

The shaft 35 is formed with a flange 35*a* at the head of one end thereof. The flange 35*a* is fit in one concave portion formed in the movable core 22 and opposite to the flange 35*a*. The surface of the other end of the shaft 35 does not abut on the movable contact 30 to secure a slight clearance between itself and the movable contact 30 when the relay coil 19 is de-energized. However, the surface of the other end of the shaft 35 can slightly abut on the surface of the movable contact 30 as long as there are no affects on the contact pressure applied by the contact pressure spring 40 between the movable contact 30 and the first and second stationary contacts 28 and 29, that is, as long as the contact pressure is maintained.

In the clearance between the inner circumferential surface of the through hole of the magnetic-circuit component and the outer circumferential surface of the shaft 35, and between the flange 35*a* and the guide member 35*b*, a return spring 41 is disposed for separating the movable core 22 from the fixed core 24 to a set side (an anti fixed-core direction). One end of the return spring 41 is supported by the flange 35*a* of the shaft 35, and the other end is supported by an axial surface of the guide member 33*b*. This results in that the shaft 35 is pressed by the load of the return spring 41 on the movable core 22 with the flange 35*a* fit in the concave portion of the movable core 22.

The resistor 7 serves to reduce in-rush current caused when the main contact of the electromagnetic switch 5 is closed. Specifically, the resistor 7 is disposed in the contact chamber 39 with its one end electrically and mechanically joined to the bolt head of the first external connection terminal 26 and with its other end electrically and mechanically joined to the bolt head of the second external connection terminal 27.

The resistor 7 is arranged to provide a preset space between itself, the inner circumferential surface of the contact cover 25, and the surface of the resin member 33*a* in order to prevent the resistor 7 from abutting on the outer circumferential surface of the shaft 35 and prevent the resin contact cover 25 and the resin member 33*a* from being thermally damaged at red heat of the resistor 7.

For example, as illustrated in FIG. 1, the resistor 7 is comprised of one end 7*a* electrically and mechanically joined to the bolt head of the first external connection terminal 26, the other end 7*b* electrically and mechanically joined to the bolt head of the second external connection terminal 27, and a joint portion 7*c* continuously joining between the one end 7*a* and the other end 7*b*. Between the one end 7*a* and the other end 7*b*, the joint portion 7*c* bypasses the shaft 35 and extends to provide the preset space between itself, the inner circumferential surface of the contact cover 25, and the surface of the resin member 33*a*.

Referring to FIG. 3, the control circuit 31 is electrically connected with a power supply line L1 for supplying power from the battery 6 to the relay coil 19, and disposed electrically upstream of the relay coil 19. The control circuit 31 is also electrically connected with the starting switch 42 via a signal line L2 for transmitting trigger signals to activate the control circuit 31.

For example, the control circuit 31 is constructed by an IC. Specifically, the control circuit 31 is comprised of internal circuit elements and a package P that protects the internal circuit elements. The control circuit 31 is disposed in the relay case 20 with the package P intimate contacting with the surface of the partitioning wall member 23, and molded together with the magnetic-circuit component in the resin member 33*a* integrally formed with the bobbin 33 set forth above. This means that the control circuit 31 and the magnetic-circuit component are molded with resin constituting the resin member 33*a* and the bobbin 33.

Figure 2:
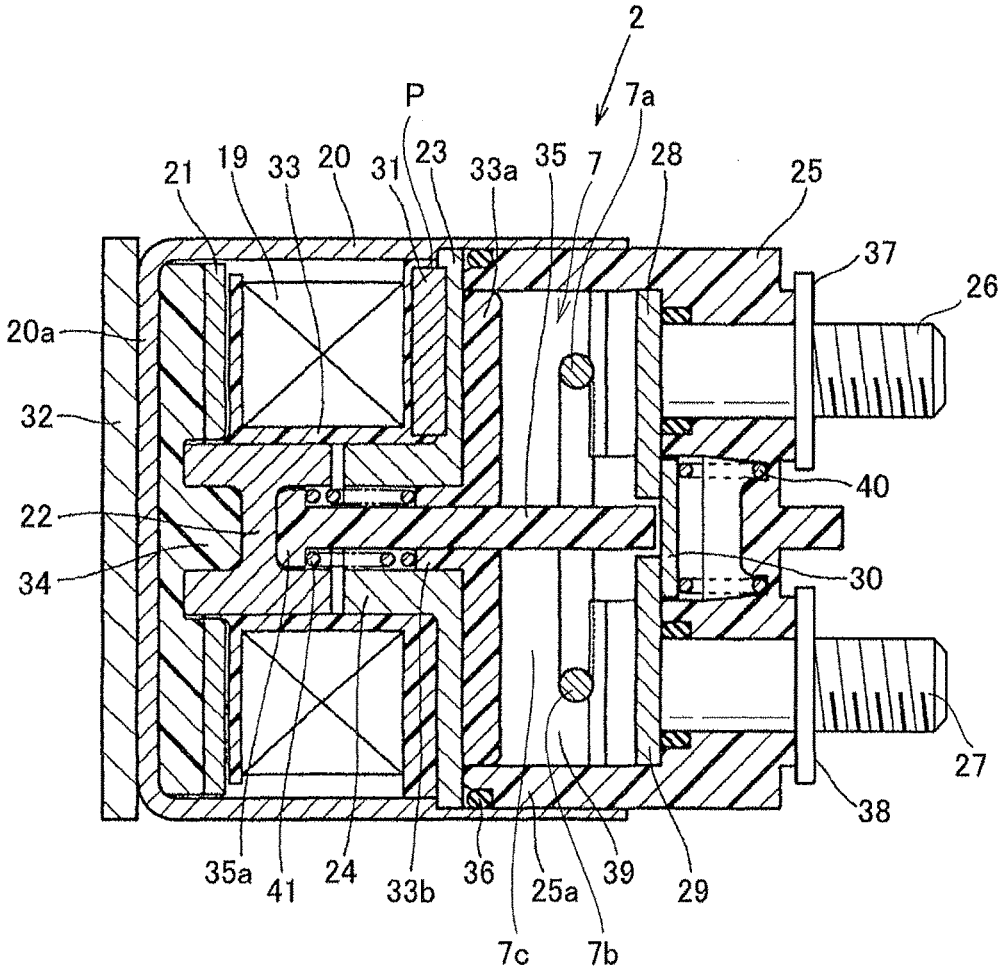
FIG. 2 is a cross sectional view of a motor energizing relay according to a modification of the first embodiment.

Note that the control circuit 31 can be disposed in the relay case 20 with the package P intimate contacting with the surface of the partitioning wall member 23. For example, in this embodiment, as illustrated in FIG. 1, the control circuit 31 is mounted on the surface of the anti-coil side (the right side in FIG. 1) of the partitioning wall member 23 to be molded in the resin member 33*a*. However, as illustrated in FIG. 2, the control circuit 31 can be mounted on the surface of the coil side (the left side in FIG. 1) of the partitioning wall member 23 to be molded in the second flange of the bobbin 33.

Next, operations of the starter 1 will be described hereinafter.

When the starting switch 42 illustrated in FIG. 3 is turned on, the starter relay 12 is closed and a trigger signal is transmitted to the control circuit 31, so that a drive signal is outputted from the control circuit 31 to the motor energizing relay 2. Note that the starting switch 42 is adapted to be turned on in response to a user's manual operation. In a vehicle in which an idle reduction system for automatically controlling stop and restart of an engine is installed, the starting switch 42 is adapted to be turned on in response to a user's operation, such as a brake-release operation and a shift operation to the drive range, after the stop of the engine (the stop of rotation of the engine's output shaft) by execution of an idle-stop operation or during speed reduction period until the engine is stopped.

When the excitation coil 13 is energized by the closure of the starter relay 12, an electromagnet is formed so that the plunger 14 is attracted. This movement of the plunger 14 shifts, via the shift lever 15, the pinion 10 together with the clutch 9 toward the anti-motor direction with the pinion 10 rotated on the outer circumferential surface of the output shaft 4 in the helical spline, so that the pinion 10 is stopped with its axial end surface abutting onto an axial end surface of the ring gear 11. The movement of the plunger 14 causes the movable contact 18 to abut onto the stationary contacts 16 and 17 to close the main contact substantially simultaneously with the abutment of the pinion 10 onto the ring gear 11 (actually, a slight mechanical delay arises).

Note that the pinion 10 may be smoothly engaged with the ring gear 11 without abutting onto the ring gear 11 with a very low probability. Normally, the pinion 10 is likely to abut onto the end surface of the ring gear 11.

On the other hand, the drive signal to the relay 2 is turned on by a predetermined duration by the control circuit 31, and thereafter, turned off. The on-state drive signal energizes the relay coil 19 as illustrated in FIG. 3. The energization of the relay coil 19 moves the movable core 22 toward the other end side (the right side in FIG. 1) of the relay 2 against the biasing force of the return spring 41, so that the shaft 35 moves toward the other end side of the relay 2 to press the movable contact 30 toward the other end side of the relay 2. This moves the movable contact 30 toward the other end side of the relay 2 against the biasing force of the return spring 40. As a result, the movable contact 30 is separated from the stationary contacts 28 and 29. That is, the relay contact of the relay 2 is opened (turned off).

As illustrated in FIG. 3, when the relay contact is opened, current flows through the motor 3 from the battery 6 via the resistor 7 because the main contact is closed. At that time, the action of the resistor 7 causes a voltage, which is lower than the full voltage of the battery 6, to be applied to the motor 3, so that a limited current flows through the motor 3. Specifically, the turn-on of the main contact restricts in-rush current flowing from the battery 6 to thereby reduce terminal-voltage drop across the battery 6. This makes it possible to prevent "short break" of in-vehicle electric devices, such as meters and audio devices, which operate on power from the battery 6.

The limited current, which flows through the motor 3, causes the motor 3 to turn at a low speed. This results in that the pinion 10, which is in abutment on the ring gear 11, is engaged with the ring gear 11.

After engagement of the pinion 10 with the ring gear 11 under rotation of the motor 3, the drive signal supplied to the motor energizing relay 2 is turned off. This de-energizes the relay coil 19, so that the movable core 22 is separated from the fixed core 24 by the biasing force of the return spring 41 to be shifted to the one end side (the set side) of the relay 2. The shift of the movable core 22 makes the shaft 35 move toward the one end side of the relay 2, removing the pressing force from the shaft 35 to the movable contact 30. As a result, the movable contact 30 moves by the biasing force by the contact pressure spring 40 toward the one end side of the relay 2 so as to abut onto the stationary contacts 28 and 29. This closes (turns on) the relay contact of the relay 2.

The closure of the relay contact forms an electric conduction path that short-circuits both ends of the resistor 7, which energizes the motor 3 based on the full-voltage of the battery 3, resulting in rotation of the motor 3 at a high speed. The high-speed rotation of the motor 3 is transferred from the pinion 10 to the ring gear 11, thus cranking the engine.

Effects of the First Embodiment

As described above, the relay 2 according to this embodiment incorporates therein the control circuit 31 for turning on or off the relay 2. Specifically, in this embodiment, the control circuit 31 is accommodated in the housing of the motor energizing relay 2; the housing is constructed by the relay case 20 and the contact cover 25. This results in elimination of any dedicated housing for the control circuit, reduction in points of connection, such as connectors, for wiring between the control circuit 31 and the relay 2, and simplification of wiring around the relay 2. This makes it possible to improve the reliability of the relay 2.

Incorporation of the control circuit 31 in the relay 2 facilitates electrical connections between the control circuit 31 and the relay coil 19, and improves the installability because there is no need to secure a space for installation of the control circuit 31 separately from the relay 2.

In addition, if the control circuit 31 were installed separately from the relay 2, such as arranged outside of the relay 2, electrical wires connecting between the control circuit 31 and the relay coil 19 would be exposed externally. This would need caution while routing of electrical wiring, and there could be a break in a wire due to external vibrations, such as engine vibrations.

In contrast, in this embodiment, electrical connections between the control circuit 31 and the relay coil 19 are completed within the housing of the relay 2. This eliminates the need to externally route electrical wiring connecting the control circuit 31 and the relay coil 19, and there are no possibilities of breaks of wires due to vibrations. In addition, because the control circuit 31 is stored in the housing of the relay 2, it is possible to ensure waterproof by the housing of the relay 2, thus improving the reliability and the environment resistance.

In this embodiment, because an IC is used as the control circuit 31, it is possible to improve the heat resistance in comparison to, for example, a plated circuit on which a plurality of circuit elements are mounted. In addition, the package P of the control circuit 31 is attached in intimate contact with the metal partitioning wall member 23 with heat dissipation. This can transfer heat (Joule heat) due to loss of the circuit to the partitioning wall member 23, thus improving the lifetime of the circuit and increasing the energized duration. The control circuit 31 is also molded together with the partitioning wall member 23 in the resin member 33*a* integrally formed with the bobbin 33. This reliably fixes the control circuit 31, and prevents abrasion powders of the relay contact from depositing between IC terminals, thus preventing reduction in the insulating properties between the IC terminals due to the abrasion powders.

This improves the environment resistance of the control circuit 31, thus positively using the relay 2 under harsher conditions in ambient temperatures and vibrations.

Furthermore, as illustrated in FIG. 3, the control circuit 31 according to the first embodiment is electrically connected with the power supply line L1 for supplying power from the battery 6 to the relay coil 19, and disposed electrically upstream of the relay coil 19. With the configuration, only interposing the control circuit 31 between a power input terminal and the relay coil 19 allows the control circuit 31 to operate without widely changing the power input terminal, a signal input terminal of the relay coil 19, and a signal route of the ground terminal of the relay coil 19. This makes it possible to easily use the control circuit 31 according to the present invention for similar electromagnetic relays.

Second Embodiment

Figure 4:
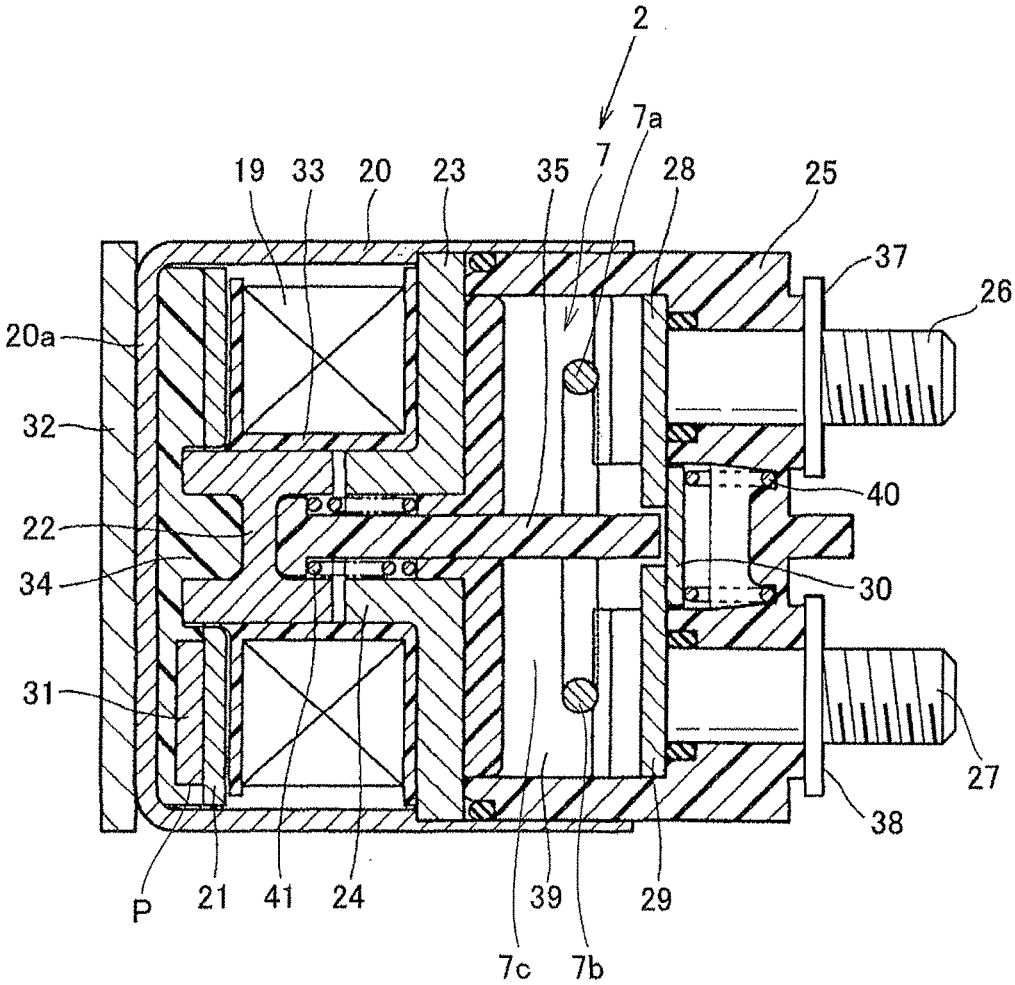
FIG. 4 is a cross sectional view of a motor energizing relay according to the second embodiment of the present invention.

This second embodiment uses an IC as the control circuit 31 as well as the first embodiment. Moreover, as illustrated in FIG. 4, the package P of the IC is attached in intimate contact with the surface of the anti-coil side (the left side in FIG. 4) of the magnetic plate 21. As illustrated in FIG. 4, the control circuit 31 is molded in the resin spacer member 34, in other words, the control circuit 31 is molded in a resin constituting the resin spacer member 34.

In this embodiment, the control circuit 31 is accommodated in the housing of the relay 2. This achieves the same effects as the first embodiment.

In addition, the magnetic plate 21 made of metallic construction, such as iron, has heat dissipation. For this reason, attaching the package P of the IC (control circuit 31) to the magnetic plate 21 in intimate contact therewith allows heat due to loss of the control circuit 31 to be transferred to the magnetic plate 21. This improves the lifetime of the control circuit and increases the energized duration of the relay 2.

The control circuit 31 is molded in the resin spacer member 34. This allows the control circuit 31 to be reliably fixed, and prevents abrasion powders of the relay contact from depositing between IC terminals, thus preventing reduction in the insulating properties between the IC terminals due to the abrasion powders.

This improves the environment resistance of the control circuit 31, thus positively using the relay 2 under harsher conditions in ambient temperatures and vibrations.

Third Embodiment

Figure 5:
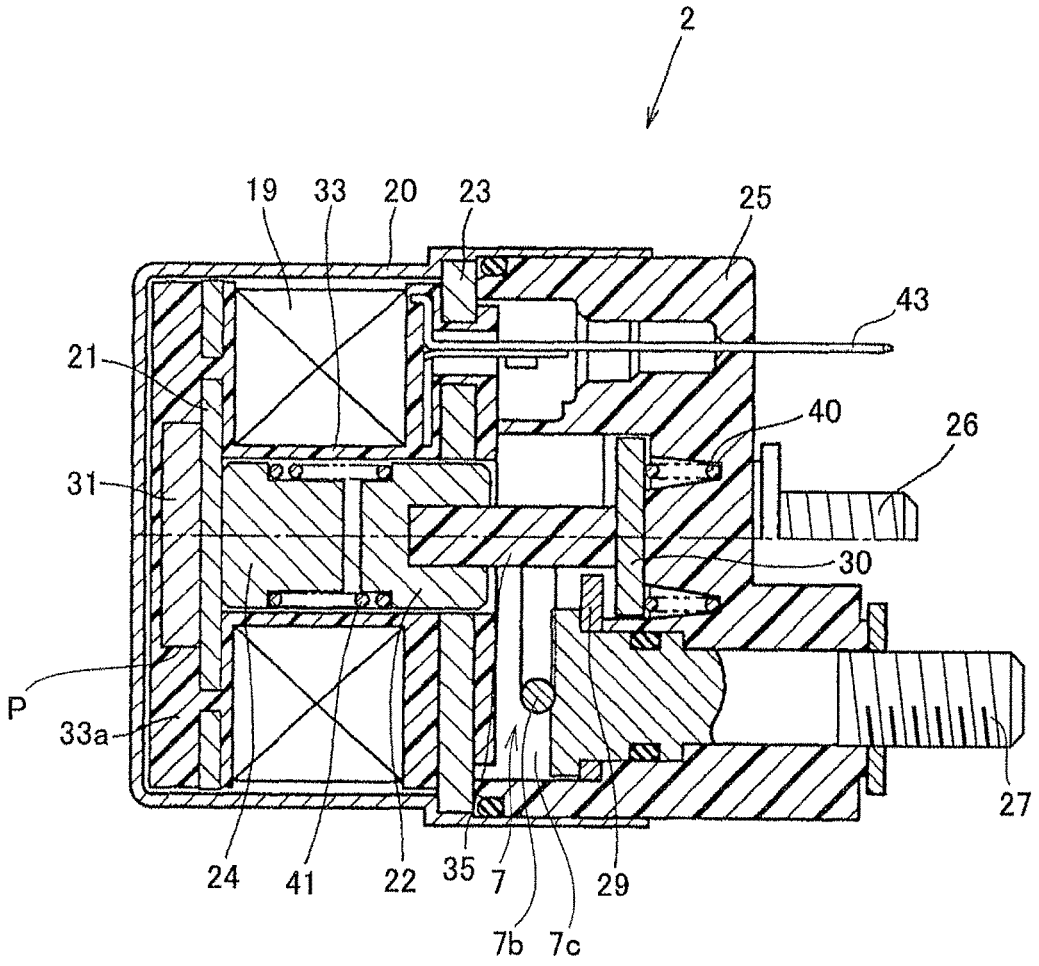
FIG. 5 is a cross sectional view of a motor energizing relay according to the third embodiment of the present invention.

Referring to FIG. 5, the relay 2 according to the third embodiment has a normally-open contact structure in which the relay contact is closed when the relay coil 19 is energized.

In comparison to the structures described in the first and second embodiments, the relay 2 according to this embodiment is configured such that the positional relationship between the fixed core 24 and the movable core 22 is reversed in the axial direction of the relay 2.

Specifically, the fixed core 24 for example having a cylindrical shape is disposed such that the flange at its one end is mounted on the surface of the coil side (the right side in FIG. 1) of the metal magnetic plate 21 with, for example, a discoid shape. The movable core 22 is disposed with its one end opposite to the fixed core 24. In a tubular grooved portion formed on the other radiused end of the movable core 22, which is wider in radius than the one end, one end of the shaft 35 is fit. The surface of the other end of the shaft 35 abuts onto the movable contact 30 biased by the contact pressure spring 40.

Between the flange of the fixed core 24 and the other end of the movable core 22, the return spring 41 is provided; the return spring 41 urges the movable core 22 in the direction in which the movable core 22 is separated from the fixed core 24 with the relay coil 19 deenergized. This results in that the movable contact 30 is in noncontact with the fixed contacts 28 and 29 (the relay contact is opened) with the relay coil 19 deenergized (the second fixed contact 29 is only illustrated in FIG. 5).

Specifically, in the third embodiment, when the relay coil 19 is energized, the movable core 22 is pulled to abut onto the fixed core 24 against the reaction force of the return spring 41 between the movable core 22 and the fixed core 24, that is, the movable core 22 moves in the left direction illustrated in FIG. 5. This causes the movable contact 30 urged by the contact pressure spring 40 to abut onto the first and second fixed contacts 28 and 29, thus closing the relay contact.

On the other hand, with the relay coil 19 deenergized, the movable core 22 is pressed to be returned to the set side (in the direction opposite to the fixed core) by the reaction force of the return spring 41. This results in that the movable contact 30 is separated from the first and second fixed contacts 28 and 29 against the reaction force of the contact pressure spring 40, thus opening the relay contact.

As well as the first and second embodiments, the control circuit 31, which can use an IC, is attached such that the package P of the IC is closely contacted to the surface of the anti-fixed-core side of the magnetic plate 21, and is molded in a resin member 33*a* integrally formed with the bobbin 33.

Note that reference character 43 in FIG. 5 represents an external terminal to be taken out from the contact cover 25. The external terminal 43 is electrically connected with the control circuit 31; the external terminal 43 allows the control circuit 31 to externally transmit and receive signals.

As described above, for the motor energizing relay 2 with the normally-open contact structure, the control circuit 31 being housed within the housing of the motor energizing relay 2 achieves the similar effects. As well as the second embodiment, the IC package P is attached to the metal magnetic plate 21 in intimate contact therewith, and molded in the resin member 33*a* together with the magnetic plate 21. This improves the environment resistance of the control circuit 31, thus positively using the relay 2 under harsher conditions in ambient temperatures and vibrations.

Fourth Embodiment

This fourth embodiment is another example of the structure that the control circuit 31 (IC) is accommodated in the housing of the normally-open relay 2 as well as the third embodiment. The fourth embodiment has characteristics in a signal transfer path for transferring, to the control circuit 31, signals inputted via the external terminal 43 taken out from the contact cover 25.

Figure 6:
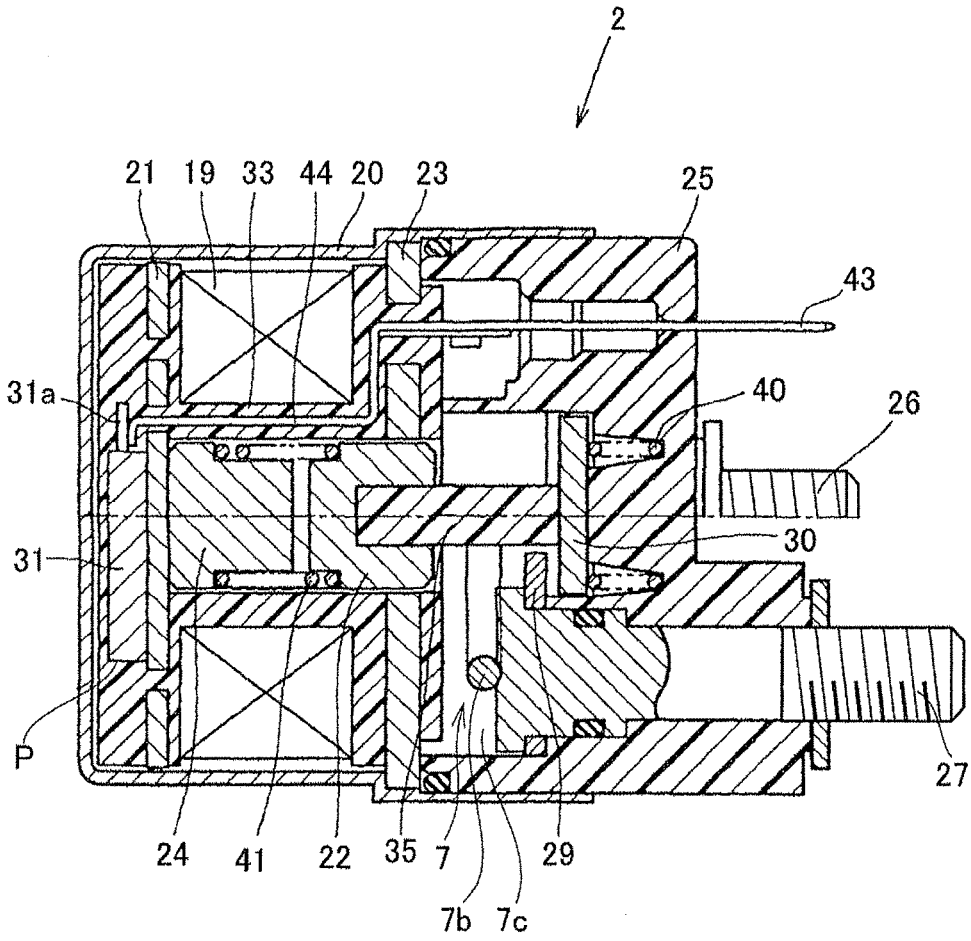
FIG. 6 is a cross sectional view of a motor energizing relay according to the fourth embodiment of the present invention.

The signal transfer path is, for example, formed by a signal transfer terminal 44 integrated with the external terminal 43 as illustrated in FIG. 6. The signal transfer terminal 44 is secondarily molded inside the cylindrical body of the bobbin 33 that supports the inner diameter of the relay coil 19.

The control circuit 31 is comprised of an IC like the third embodiment, the package P of which is resin molded together with the magnetic plate 21 while intimate contacting with the magnetic plate 21. A terminal 31*a* taken out from the control circuit 31 is electrically connected with an end of the signal transfer terminal 43.

In this embodiment, the signal transfer terminal 44 is molded inside the cylindrical body of the bobbin 33 to form the signal transfer path from the external terminal 43 to the control circuit 31 via the signal transfer terminal 44.

The aforementioned configuration eliminates the need to route a coated lead wire the radial outside of the relay coil 19 wound around the bobbin 33 for electrical connection between, for example, the control circuit 31 and the external terminal 43. That is, there is no need to secure a space to pass a coated lead wire in the radial outside of the relay coil 19. This can reduce the motor energizing relay 2 in size. Note that, in this embodiment, the external terminal 43 and the signal transfer terminal 44 are integrally provided, but can be separated while electrically coupled with each other.

Fifth Embodiment

Figure 7:
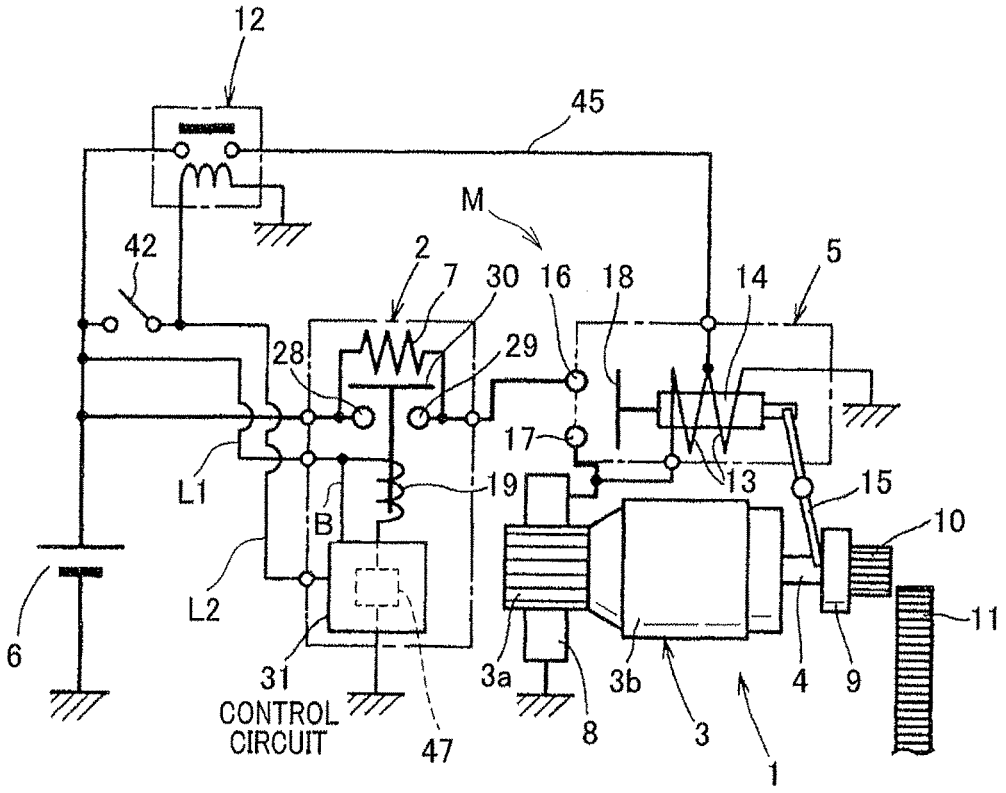
FIG. 7 is a cross sectional view of a motor energizing relay according to the fifth embodiment of the present invention.

In the first embodiment, the control circuit 31 is electrically connected with the power supply line L1 for supplying power from the battery 6 to the relay coil 19 so as to be upstream of the relay coil 19. However, in the fifth embodiment, as illustrated in FIG. 7, the control circuit 31 is electrically connected with the power supply line L1 for the relay coil 19 so as to be downstream of the relay coil 19. Note that the control circuit 31 is adapted to be energized via a branch line B separated from the power line L1.

In the configuration, a switching element 47 is interposed in the control circuit 31 between the lower-potential end of the wire of the relay coil 19 and ground; the switching element 47 is to control the energized state of the relay coil 19. Specifically, the control circuit 31 turns on the switching element 47 in response to a trigger signal, which energizes the relay coil 19, and, the control circuit 31 turns off the switching element 47, which deenergizes the relay coil 19.

The configuration of this embodiment allows a current flowing out of the relay coil 19 to flow from the ground terminal of the control circuit 31 to ground. That is, the ground terminal of the control circuit 31 is shared as the ground terminal of the relay coil 19. This reduces the number of terminals.

Sixth Embodiment

Figure 8:
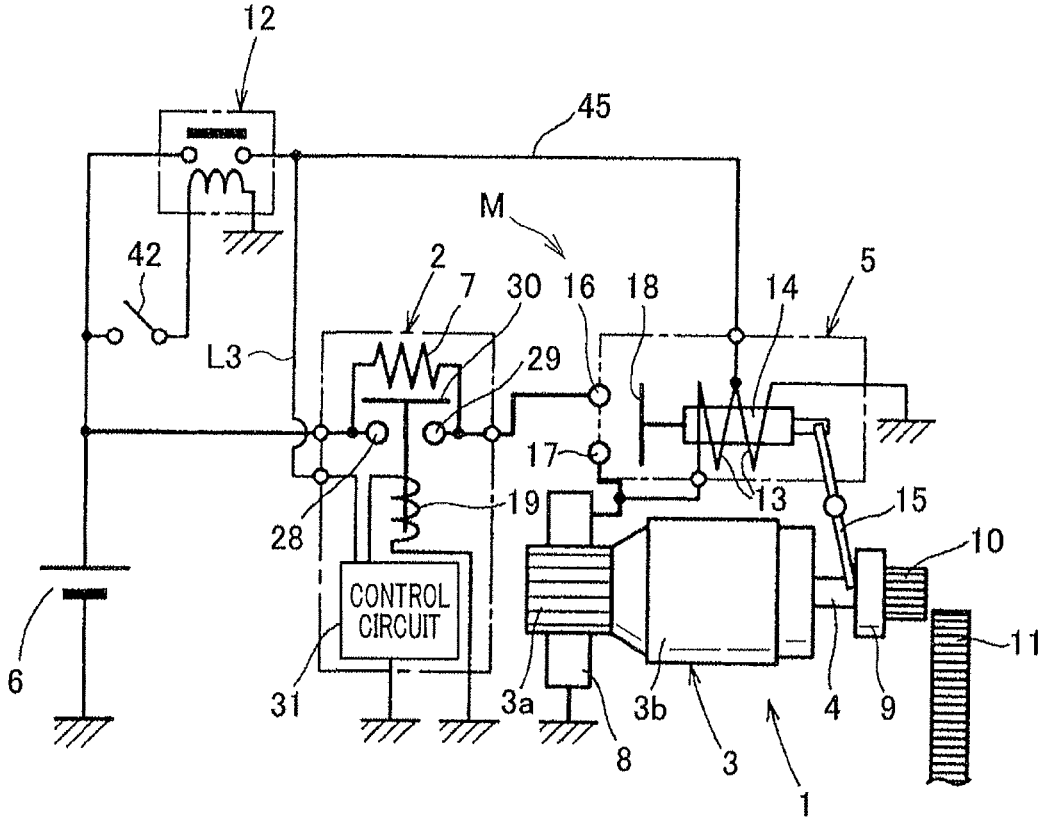
FIG. 8 is a cross sectional view of a motor energizing relay according to the sixth embodiment of the present invention.
Figure 9:
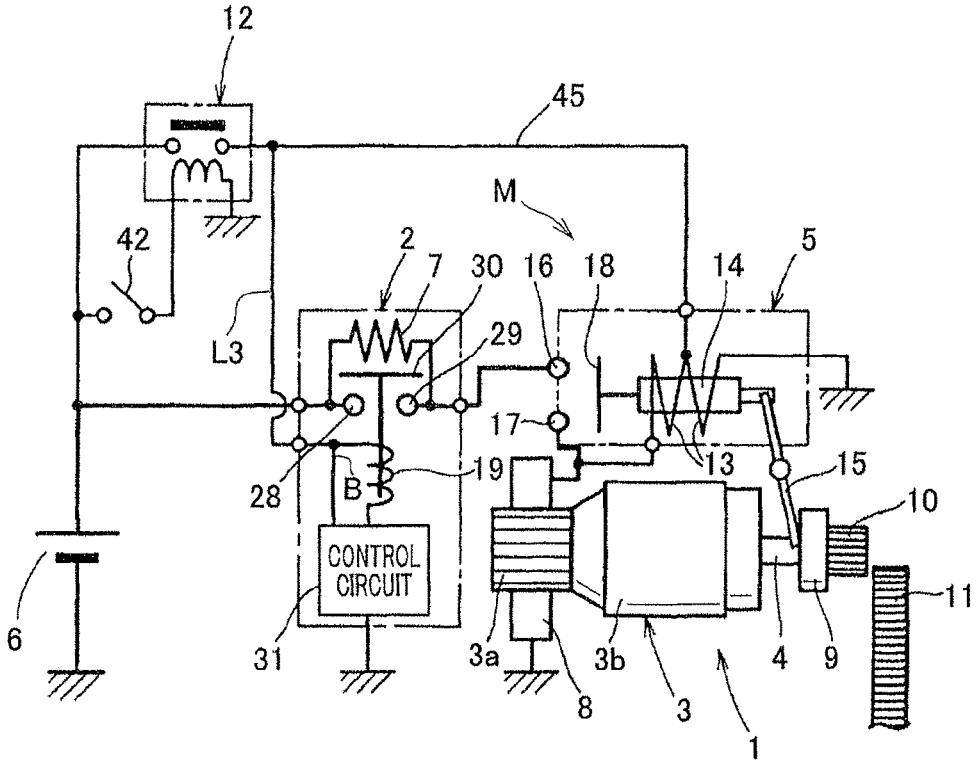
FIG. 9 is an electrical circuit diagram of a starter according to a modification of the sixth embodiment.

Referring to FIGS. 8 and 9, the sixth embodiment is an example in which a common line L3 is shared as a power line for supplying power to the control circuit 31, a power line for supplying power to the relay coil 19, and a signal line for transmitting a trigger signal to the control circuit 31 to activate the control circuit 31. The common line L3 is connected with an energization line 45 for energizing the excitation coil 13 of the electromagnetic switch 5 from the battery 6 via the starter relay 12. This allows power to be supplied from the energization line 45 to each of the control circuit 31 and the relay coil 19 via the common line L3, and the trigger signal to be captured from the energization line 45 via the common line L3.

The aforementioned configuration uses a common line for the power lines and the signal line to thereby eliminate lines being used only for power supply. This reduces the number of terminals of the motor energizing relay 2, thus simplifying it. Thus, the motor energizing relay 2 can operate by only supplying a branch signal from the energization line 45 of the electromagnetic switch 5 thereto without widely changing the existing wiring.

Note that, in the sixth embodiment, as illustrated in FIG. 8, the control circuit 31 can be disposed upstream of the relay coil 19, or can be disposed downstream of the relay coil 19 (see FIG. 9).

Seventh Embodiment

Figure 10:
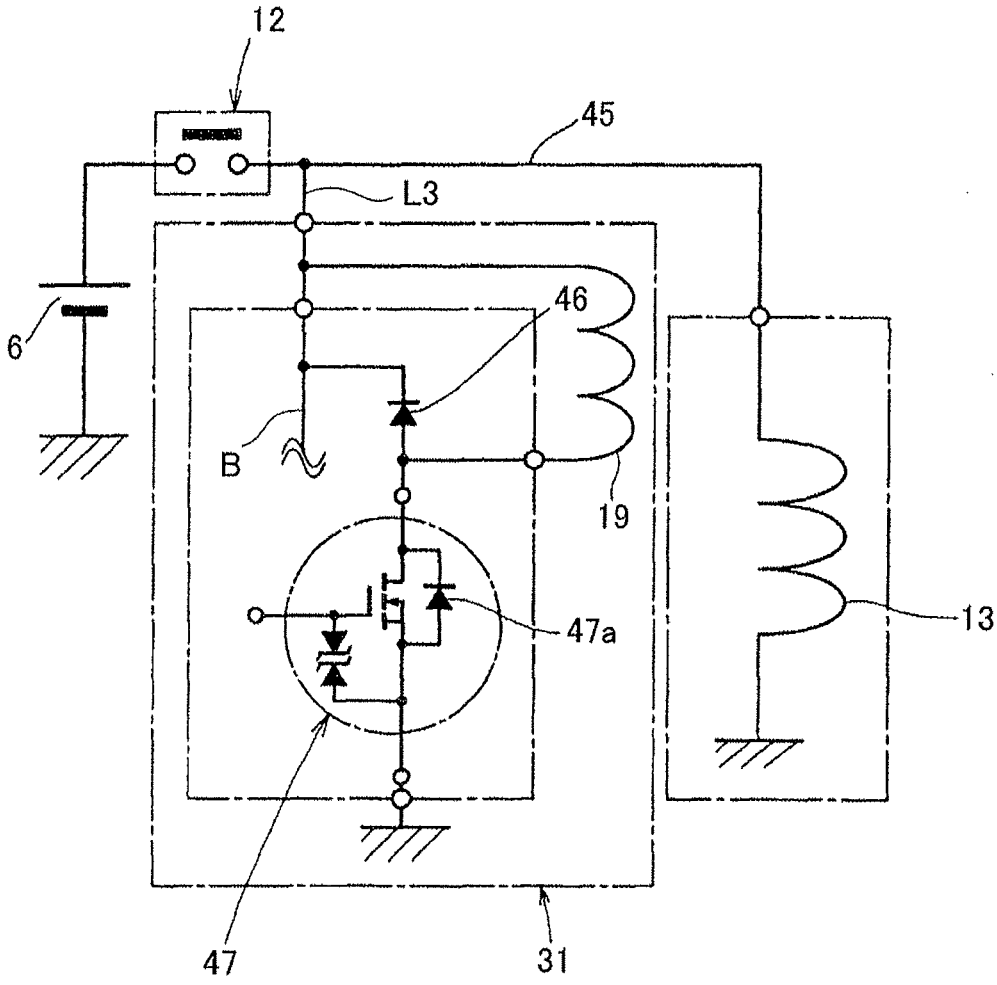
FIG. 10 is an electrical circuit diagram of a starter according to the seventh embodiment of the present invention.

This seventh embodiment is a modification of the configuration described in the sixth embodiment, that is, the configuration in which the common line L3 is shared as the power lines and the signal line, and the common line L3 is connected with the energization line 45 for energizing the excitation coil 13 of the electromagnetic switch 5 (see FIG. 9). Specifically, as illustrated in FIG. 10, a surge absorbing element 46 and a MOSFET 47 as an example of switching elements are provided in the control circuit 31; the surge absorbing element 46 and the MOSFET 47 are connected in series with each other.

As the surge absorbing element 46, a diode is for example used. The cathode of the diode 46 is connected with the common line L3, and the anode is connected with the lower-potential end of the wire of the relay coil 19. The diode 46 is operative to absorb a surge generated when the relay coil 19 is deenergized, in other words, the starter relay 45 provided on the energization line 45 is opened.

As described above, the MOSFET 47 is a switching element that controls the energized state of the relay coil 19. A surge, which flows from the excitation coil 13 of the electromagnetic switch 5 to pass through the energization line 45 into the control circuit 31, is absorbed by an intrinsic diode formed in the MOSFET 47.

The aforementioned configuration reduces an arc caused from the contacts of the starter relay 12 due to a surge generated in the excitation coil 13 of the electromagnetic switch 5 when power supply is stopped, thus improving the lifetime of the starter relay 12.

Eighth Embodiment

In this eighth embodiment, one or more functions provided in the control circuit 31 accommodated in the housing of the motor energizing relay 2 will be described.

Figure 11:
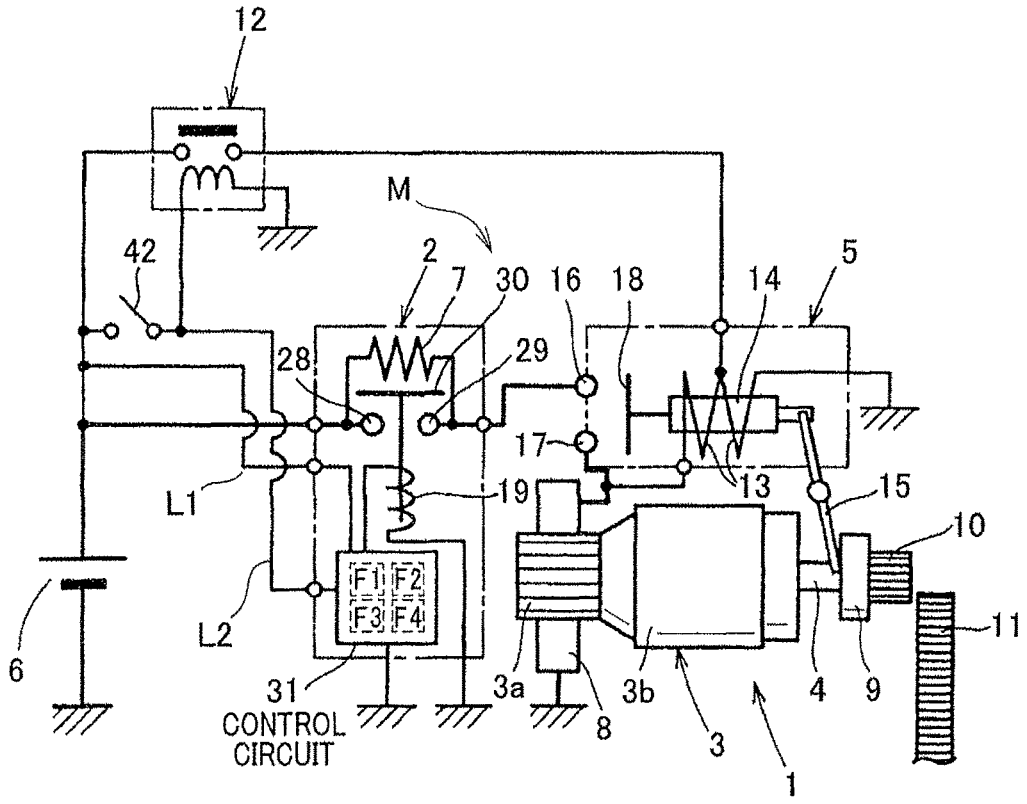
FIG. 11 is an electrical circuit diagram of a starter according to the eighth embodiment of the present invention.
Figure 12:
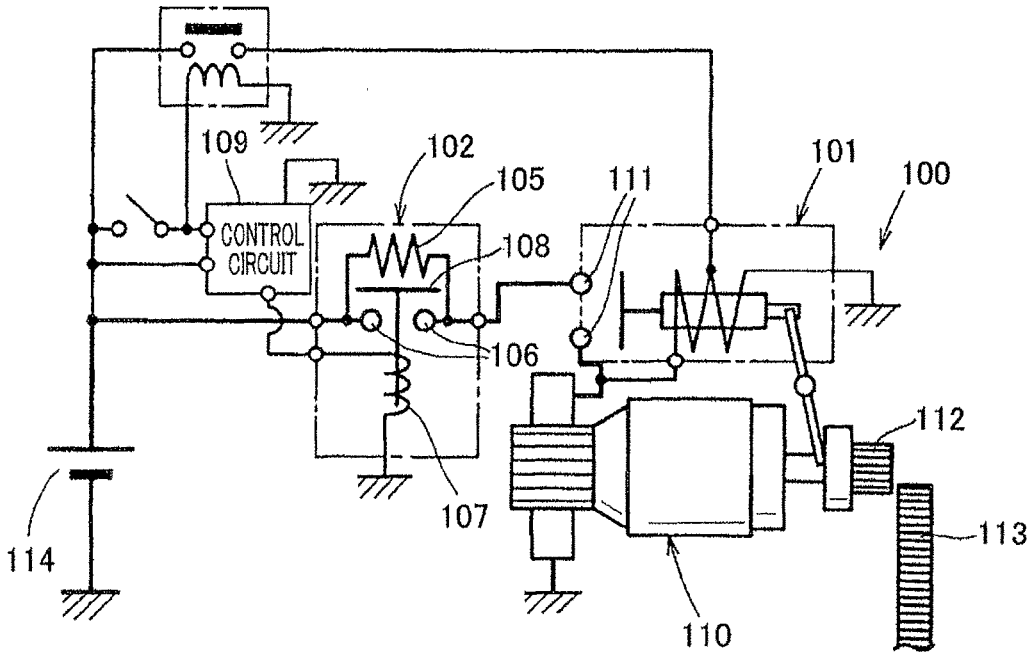
FIG. 12 is an electrical circuit diagram of a conventional starter.
Figure 13:
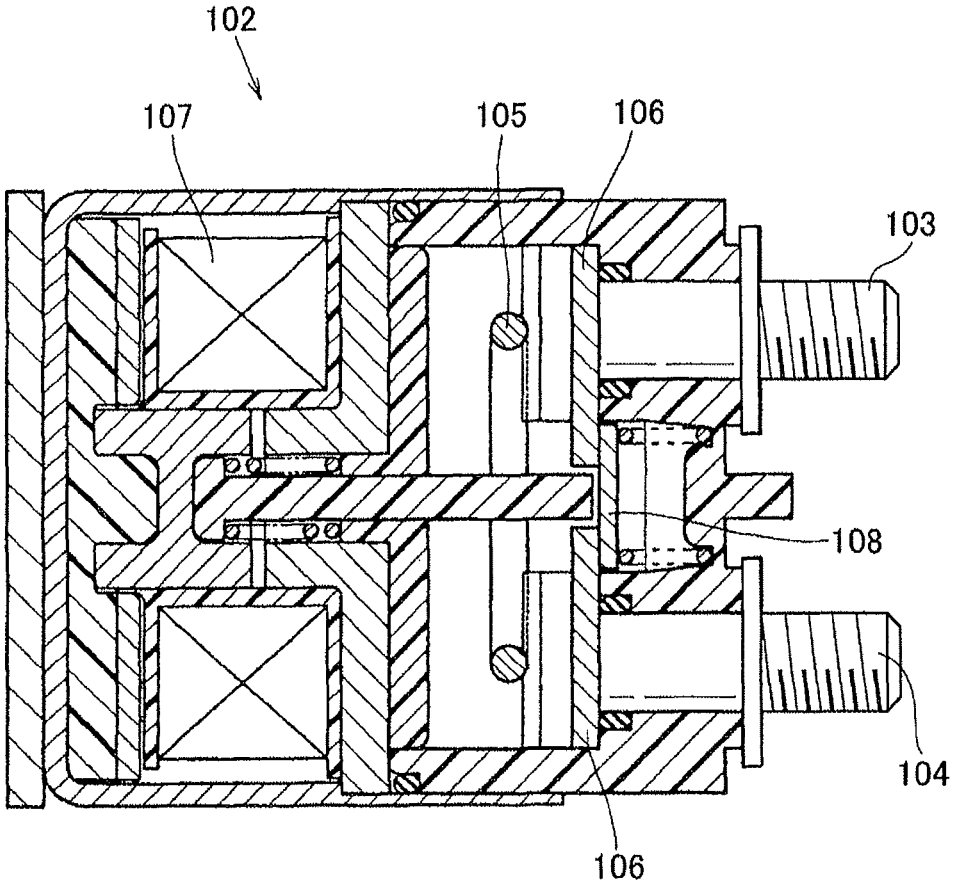
FIG. 13 is a cross sectional view of a conventional motor energizing relay.

As illustrated in FIG. 11, the control circuit 31 according to this embodiment comprises any one of or at least some of: the function F1 of preventing activation-current reduction, the temperature protection function F2, the overcurrent protection function F3, and the function F4 of adjusting energized duration of resistors. Note that, in FIG. 11, the control circuit 31 is equipped with all the functions F1 to F4, but, as described above, the control circuit 31 can be equipped with any one of the functions F1 to F4.

The function F1 of preventing activation-current reduction is, for example, a function used in an idle reduction vehicle for automatically controlling engine stop and restart; the function prevents reduction in an activation current for the motor 3 during idle reduction being disabled in the system, in other words, during a cold period in which the engine is difficult to crank. For example, when a signal for the prevention of activation-current reduction is sent from an external device D of the relay 2, such as an ECU, the function does not energize the motor 3 via the resistor 7 at engine startup, but energizes the motor 3 based on the full voltage of the battery 6. This makes it possible to improve the start-up performance of the engine even during a cold period in which the engine is difficult to crank.

The temperature protection function F2 has a function of detecting the temperature of the control circuit 31 itself or the ambient temperature. As a result, when detecting an abnormal temperature exceeding a preset allowable temperature, the temperature protection function F2 shuts down power to be supplied to the control circuit 31. This prevents induction of circuit failure due to the use of the control circuit 31 at abnormal temperatures.

The overcurrent protection function F3 is a function of shutting down power to be supplied to the control circuit 31 when an overcurrent, which exceeds a preset allowable current, flows. This prevents induction of circuit failure due to the flow of an overcurrent through the control circuit 31.

The function F4 is a function of adjusting an energized duration of the resistor 7 in energization of the motor 3 via the resistor 7 at activation of the motor 3. For example, when it is determined, from a detection signal from a temperature sensor of the starter 1 as an external device D of the relay 2, that the starter 1 is a high-temperature state with its temperature exceeding a preset temperature, the function F4 increases the energized duration of the resistor 7, that is, the duration of the relay contact being opened. As a result, it is possible to improve the start-up performance of the engine, and supply, in a balanced manner, a starter current so as to reduce voltage drop across the battery 6 generated by the starter current.

Ninth Embodiment

As well as the first embodiment, a motor energizing relay 2 according to the ninth embodiment has a normally-closed contact structure in which the movable contact 30 abuts onto the first and second stationary contacts 28 and 29 with the relay coil 19 de-energized so that the relay contact is closed.

In addition, the control circuit 31 is disposed in the contact chamber 39, and equipped with at least the temperature protection function F2 in the four functions F1 to F4 described in the eighth embodiment.

The control circuit 31 subjects to radiation heat emitted from the resistor 7 when the resistor 7 is energized. Note that, as illustrated in FIG. 2, 4, 5, or 6, the control circuit 31 is disposed while keeping a suitable distance with respect to the resistor 7 for prevention of failure of the control circuit 31 due to heat of the resistor 7 before activation of the temperature protection function. In other words, the control circuit 31 is located in an area that allows the temperature protection function to be effectively performed upon heat being produced from the resistor 7.

According to the configuration of this embodiment, when the control circuit 31 detects an abnormal temperature due to heat being produced from the resistor 7 caused by abnormal continuous energization of the resistor 7, the temperature protection function F2 works to shut down the supply of power to the control circuit 31. This deactivates the control circuit 31 to interrupt a drive signal to the relay coil 19; the interruption closes the relay contact to form an energization path bypassing the resistor 7. This results in limitation of current flowing through the resistor 7, thus reducing production of heat from the resistor 7. This prevents the resistor 7 from being melted due to such abnormal heat of the resistor 7.

Thereafter, when the system returns to normal, there is no need to replace the resistor 7 so that the resistor 7 can be continuously used because the resistor 7 was not melted. In addition, when the system returns to normal, the relay 2 operates normally because there is nothing wrong with the control circuit 31.

Modifications

In the first embodiment, as an example, both ends of the resistor 7 are joined to the bolt heads of the respective first and second external connection terminals 26 and 27. However, both ends of the resistor 7 need not be joined directly to the bolt heads of the respective first and second external connection terminals 26 and 27 as long as the resistor 7 of the relay 2 according to the present invention are electrically connected between the first and second external connection terminals 26 and 27. That is, both ends of the resistor 7 can be joined indirectly to the bolt heads of the respective first and second external connection terminals 26 and 27.

The relay case 20 of the relay 2 has a bottomed cylindrical shape, but it need not have a cylindrical shape. Specifically, the relay case 20 can have a shape whose cross section orthogonal to its axial direction has a polygon shape, such as a rectangular shape and a hexagonal shape.

In each of the aforementioned embodiments, the relay 2 is provided upstream of the main contact of the electromagnetic switch 5, but can be provided downstream of the main contact, that is, provided between the M terminal bolt and the motor 3.

DESCRIPTION OF CHARACTERS

1 Starter
2 Motor energizing relay (Electromagnetic relay)
3 Motor
5 Electromagnetic switch (Electromagnetic switch for starters)
6 Battery
7 Resistive element
12 Starter relay
13 Excitation coil of electromagnetic switch
19 Relay coil
20 Relay case (bottomed case or housing)
20*a* Bottom portion of relay case
21 Magnetic plate (first partitioning wall member)
22 Movable core
23 Partitioning wall member (Second partitioning wall member)
24 Fixed core
25 Contact cover (housing)
26 First external connection terminal
27 Second external connection terminal
28 First stationary contact
29 Second stationary contact
30 Movable contact;
31 Control circuit
33 Bobbin
33*a* Resin member integrally formed with bobbin
39 Contact chamber
43 External terminal
44 Signal transfer terminal
45 Energization line
46 Surge absorbing element
47 MOSFET

The invention claimed is:

1. An engine starting system comprising:

a motor;

an electromagnetic switch comprising an excitation coil and a plunger that moves by the excitation coil, and configured to open or close a main contact provided in a motor circuit for current supply to the motor from a battery;

an electromagnetic relay comprising:

a resistor connected to the motor circuit;

a relay contact that, when closed, is connected to the motor circuit while bypassing the resistor; and a relay coil, the electromagnetic relay having a normally closed contact structure in which the relay contact is closed when the relay coil is de-energized;

a control circuit that controls open and close of the relay contact; and a starting switch, wherein:

the starting switch is configured to, when turned-on, cause a triggering signal to be transmitted to the control circuit, and the control circuit is configured to:

when the triggering signal is received, output a drive signal to the relay coil, which energizes the relay coil so that the relay contact is opened such that current flows from the battery to the motor via the resistor; and de-energize the relay coil to re-close the relay contact after a predetermined duration of the current flowing to the motor via the resistor, the de-energized relay coil causing formation of an electric conduction path that bypasses both ends of the resistor, the electric conduction path energizing the motor based on a full-voltage of the battery.

2. The engine starting system according to claim 1, wherein the main contact, when closed, causes the current flowing via the resistor while being limited thereby to be supplied to the motor, and the relay contact, when closed, causes a current flowing through the electrical conductive path to energize the motor.

3. The engine starting system according to claim 2, wherein the control circuit closes the relay contact after lapse of a predetermined duration.

4. The engine starting system according to claim 3, wherein the electromagnetic relay further comprises: a shaft made of a resin member; and a movable core that moves when the relay coil is energized, the relay contact being comprised of a movable contact and a stationary contact, and the control circuit energizes the relay coil to move the movable core, movement of the movable core being transferred to the movable contact via the shaft, so that the movable contact is separated from the stationary contact, thus opening the relay contact.

5. The engine starting system according to claim 2, wherein the electromagnetic relay further comprises: a shaft made of a resin member; and a movable core that moves when the relay coil is energized, the relay contact being comprised of a movable contact and a stationary contact, and the control circuit energizes the relay coil to move the movable core, movement of the movable core being transferred to the movable contact via the shaft, so that the movable contact is separated from the stationary contact, thus opening the relay contact.

6. The engine starting system according to claim 1, wherein the control circuit closes the relay contact after lapse of a predetermined duration.

7. The engine starting system according to claim 6, wherein the electromagnetic relay further comprises: a shaft made of a resin member; and a movable core that moves when the relay coil is energized, the relay contact being comprised of a movable contact and a stationary contact, and the control circuit energizes the relay coil to move the movable core, movement of the movable core being transferred to the movable contact via the shaft, so that the movable contact is separated from the stationary contact, thus opening the relay contact.

* * * * *